US007412848B2

(12) United States Patent
Johnson et al.

(10) Patent No.: US 7,412,848 B2
(45) Date of Patent: Aug. 19, 2008

(54) JEWELRY MADE OF PRECIOUS A MORPHOUS METAL AND METHOD OF MAKING SUCH ARTICLES

(76) Inventors: William L. Johnson, 3546 Mountain View, Pasadena, CA (US) 91107; Atakan Peker, 17 Coffeeberry, Aliso Viejo, CA (US) 92656

( * ) Notice: Subject to any disclaimer, the term of this patent is extended or adjusted under 35 U.S.C. 154(b) by 406 days.

(21) Appl. No.: 10/534,375

(22) PCT Filed: Nov. 21, 2003

(86) PCT No.: PCT/US03/37394

§ 371 (c)(1), (2), (4) Date: Oct. 4, 2005

(87) PCT Pub. No.: WO2004/047582

PCT Pub. Date: Jun. 10, 2004

(65) Prior Publication Data

US 2006/0037361 A1 Feb. 23, 2006

(51) Int. Cl.
*A44C 25/00* (2006.01)
*A44C 27/00* (2006.01)

(52) U.S. Cl. ..... 63/23; 164/516; 164/113; 164/122

(58) Field of Classification Search ..... None
See application file for complete search history.

(56) References Cited

U.S. PATENT DOCUMENTS

| | | | |
|---|---|---|---|
| 2,190,611 | A | 2/1940 | Sembdner |
| 3,989,517 | A | 11/1976 | Tanner et al. |
| 4,050,931 | A | 9/1977 | Tanner et al. |
| 4,064,757 | A | 12/1977 | Hasegawa |
| 4,067,732 | A | 1/1978 | Ray |
| 4,113,478 | A | 9/1978 | Tanner et al. |
| 4,115,682 | A | 9/1978 | Kavesh et al. |
| 4,116,682 | A | 9/1978 | Polk et al. |
| 4,116,687 | A | 9/1978 | Hasegawa |
| 4,126,449 | A | 11/1978 | Tanner et al. |
| 4,135,924 | A | 1/1979 | Tanner et al. |
| 4,148,669 | A | 4/1979 | Tanner et al. |
| 4,289,009 | A | 9/1981 | Festag et al. |
| 4,472,955 | A | 9/1984 | Nakamura et al. |
| 4,621,031 | A | 11/1986 | Scruggs |
| 4,623,387 | A | 11/1986 | Masumoto et al. |
| 4,648,609 | A | 3/1987 | Deike |
| 4,710,235 | A | 12/1987 | Scruggs |
| 4,721,154 | A | 1/1988 | Christ et al. |
| 4,743,513 | A | 5/1988 | Scruggs |
| 4,854,370 | A | 8/1989 | Nakamura |
| 4,976,417 | A | 12/1990 | Smith |
| 4,987,033 | A | 1/1991 | Abkowitz et al. |
| 4,990,198 | A | 2/1991 | Masumoto et al. |
| 5,032,196 | A | 7/1991 | Masumoto et al. |
| 5,053,084 | A | 10/1991 | Masumoto et al. |
| 5,053,085 | A | 10/1991 | Masumoto et al. |
| 5,074,935 | A | 12/1991 | Masumoto et al. |
| 5,117,894 | A | 6/1992 | Katahira |
| 5,131,279 | A | 7/1992 | Lang et al. |
| 5,169,282 | A | 12/1992 | Ueda et al. |
| 5,213,148 | A | 5/1993 | Masumoto et al. |
| 5,225,004 | A | 7/1993 | O'Handley et al. |
| 5,250,124 | A | 10/1993 | Yamaguchi et al. |
| 5,279,349 | A | 1/1994 | Horimura |
| 5,288,344 | A | 2/1994 | Peker et al. |
| 5,296,059 | A | 3/1994 | Masumoto et al. |
| 5,306,463 | A | 4/1994 | Horimura |
| 5,312,495 | A | 5/1994 | Masumoto et al. |
| 5,324,368 | A | 6/1994 | Masumoto et al. |
| 5,368,659 | A | 11/1994 | Peker et al. |
| 5,380,375 | A | 1/1995 | Hashimoto et al. |
| 5,384,203 | A | 1/1995 | Apfel |
| 5,390,724 | A | 2/1995 | Yamauchi et al. |
| 5,449,425 | A | 9/1995 | Renard et al. |
| 5,482,580 | A | 1/1996 | Scruggs et al. |
| 5,567,251 | A | 10/1996 | Peker et al. |
| 5,589,012 | A | 12/1996 | Hobby et al. |
| 5,711,363 | A | 1/1998 | Scruggs et al. |
| 5,797,443 | A | 8/1998 | Lin et al. |
| 5,886,254 | A | 3/1999 | Chi |
| 5,950,704 | A | 9/1999 | Johnson et al. |
| 6,021,840 | A | 2/2000 | Colvin |
| 6,027,586 | A | 2/2000 | Masumoto et al. |
| 6,044,893 | A | 4/2000 | Taniguchi et al. |

(Continued)

FOREIGN PATENT DOCUMENTS

| | | | |
|---|---|---|---|
| GB | 2236325 | A | 4/1991 |

(Continued)

OTHER PUBLICATIONS

Brochure entitled ProCAST . . . not just for castings!, UES, Inc., 1 page.

(Continued)

*Primary Examiner*—Jack W. Lavinder
(74) *Attorney, Agent, or Firm*—Kauth, Pomeroy, Peck & Bailey LLP

(57) ABSTRACT

Jewelry and methods of making jewelry containing a precious metal-base alloy component in bulk-solidified amorphous phase are provided.

34 Claims, No Drawings

U.S. PATENT DOCUMENTS

| | | | | |
|---|---|---|---|---|
| 6,200,685 | B1 | 3/2001 | Davidson | |
| 6,258,183 | B1 | 7/2001 | Onuki et al. | |
| 6,306,228 | B1 | 10/2001 | Inoue et al. | |
| 6,371,195 | B1 | 4/2002 | Onuki et al. | |
| 6,376,091 | B1 | 4/2002 | Croopnick | |
| 6,408,734 | B1 | 6/2002 | Cohen | |
| 6,446,558 | B1 | 9/2002 | Peker et al. | |
| 6,623,566 | B1 * | 9/2003 | Senkov et al. | 148/121 |
| 7,293,599 | B2 * | 11/2007 | Peker et al. | 164/516 |
| 2001/0052406 | A1 | 12/2001 | Kubota et al. | |
| 2002/0036034 | A1 | 3/2002 | Xing et al. | |
| 2002/0050310 | A1 | 5/2002 | Kundig et al. | |

FOREIGN PATENT DOCUMENTS

| | | |
|---|---|---|
| JP | 61238423 A | 10/1986 |
| JP | 06-264200 | 9/1994 |
| JP | 2000-256811 | 9/2000 |

OTHER PUBLICATIONS

Catalog Cover Entitled, Interbike Buyer Official Show Guide, 1995, 3 pages.

Eshbach et al., "Section 12—Heat Transfer", Handbook of Engineering Fundamentals, 3d ed., 1975, pp. 1113-1119.

Hasegawa et al., "Superconducting Properties of Be-Zr Glassy Alloys Obtained by Liquid Quenching", May 9, 1977, pp. 3925-3928.

Inoue et al., "Zr-A1-Ni Amorphous Alloys with High Glass Transition Temperature and Significant Supercooled Liquid Region", Materials Transactions, JIM, 1990, vol. 31, No. 3, pp. 177-183.

Inoue, et al., "Bulky La-A1-TM (TM=Transition Metal) Amorphous Alloys with High Tensile Strength Produced by a High-Pressure Die Casting Method", Materials Transactions, 1993, JIM, vol. 34, No. 4, pp. 351 to 358.

Inoue, et al., "Mg-Cu-Y Bulk Amorphous Alloys with High Tensile Strength Produced by a High-Pressure Die Casting Method", Materials Transactions, 1992, JIM, vol. 33, No. 10, pp. 937 to 945.

Jost et al., "The Structure of Amorphous Be-Ti-Zr Alloys", Zeitschrift fur Physikalische Chemie Neue Folge, Bd. 157, 1988, pp. 11-15.

Kato et al., "Production of Bulk Amorphous $Mg_{85}Y_{10}Cu_5$ Alloy by Extrusion of Atomized Amorphous Powder", Materials Transactions, JIM, 1994, vol. 35, No. 2, pp. 125 to 129.

Kawamura et al., Full Strength Compacts by Extrusion of Glassy Metal Powder at the Supercooled Liquid State, Appl. Phys. Lett. 1995, vol. 67, No. 14, pp. 2008-2010.

Lyman et al., Metals Handbook, Forging and Casting, 8th ed., 1970, vol. 5, pp. 285-291 and 300-306.

Maret et al., "Structural Study of $Be_{43}Hf_xZr_{57-x}$ Metallic Glasses by X-Ray and Neutron Diffraction", J. Physiq, 1986, vol. 47, pp. 863-871.

Polk et al., "The Effect of Oxygen Additions on the Properties of Amorphous Transition Metal Alloys", Source and date unknown, pp. 220-230.

Tanner et al., "Metallic Glass Formation and Properties in Zr and Ti Alloyed with Be-I The Binary Zr-Be and Ti-Be Systems", Acta Metallurgica, 1979, vol. 27, pp. 1727-1747.

Tanner et al., "Physical Properties of $Ti_{50}Be_{40}Zr_{10}$ Glass", Sripta Metallurgica, Jun. 22, 1977, vol. 11, pp. 783-789.

Tanner, L.E., "Physical Properties of Ti-Be-Si Glass Ribbons", Scripta Metallurgica, 1978, vol. 12, pp 703-708.

Tanner, L.E., "The Stable and Metastable Phase Relations in the Hf-Be Alloy System", Metallurgica, vol. 28, 1980, pp. 1805-1815.

Zhang et al., "Amoprphous Zr-A1-TM (TM=Co, Ni, Cu) Alloys with Significant Supercooled Liquid Region of Over 100K", Materials Transactions, JIM., 1991, vol. 32, No. 11, pp. 1005-1010.

* cited by examiner

JEWELRY MADE OF PRECIOUS A MORPHOUS METAL AND METHOD OF MAKING SUCH ARTICLES

FIELD OF THE INVENTION

The present invention relates to jewelry made of precious bulk-solidifying amorphous alloys and methods of making such articles.

BACKGROUND OF THE INVENTION

Jewelry is generally used as an ornament on the body or as a decorative item to improve the aesthetics, beauty, and intrinsic worth of an item. As an ornament, jewelry is generally worn on the body, such as earrings, necklaces, bracelets, etc. As a decorative item jewelry has been generally displayed with high-value items, such as artistic pieces. In such cases, jewelry may take the form of a frame or handle. Furthermore, the use of jewelry in personal and functional items, such as cell-phones, watches, glasses, guns and pistols, pens, faucets and plumbing is becoming more common. Such personal items have frequent contact with body parts, such as hands, and are subject to a more intensive "wear and tear" environment than other jewelry items.

Because of their attributed intrinsic worth, jewelry is generally made from precious metals such as gold, platinum, and palladium. Jewelry articles made of solid precious metals are quite common, although clad materials and veneered composites are also used to a certain degree. (Herein, jewelry is defined where the metallic component comprises at least a solid piece of precious metal alloy of more than 0.1 mm thickness. Thin-film surface coatings of precious metals are excluded from the jewelry definition, whereas jewelry comprising "veneer" or clad layers of precious metal alloys is included). Furthermore, jewelry is further enhanced in aesthetics, beauty and intrinsic worth by incorporating gemstones. Generally, it is desired that the content of precious metal in the jewelry alloy is above a minimum weight percentage such as 14 karat or 18 karat. Due to the attributed high worth of jewelry, expectations of the quality of jewelry articles are quite high. Jewelry articles are expected to be unique and exceptional in their design and they are expected to be fabricated and finished to very high standards. Even slight imperfections, subtle to the naked eye, are not generally tolerated.

Accordingly, the fabrication and finishing of jewelry articles is a highly tedious process and several challenges have yet to be satisfactorily resolved. The cast articles of precious metals generally lack the desired precision and need substantial effort in finishing operations. Furthermore, the incorporation of gemstone shows significant problems during casting and subsequent fabrication process in order to secure satisfactory and long-term fixing of gemstones firmly in place.

Jewelry articles are also expected to be durable and sustain long life. However, the common precious metal-based alloys have notoriously poor mechanical properties such as yield strength, hardness, and wear resistance. Furthermore, with the use of jewelry in personal items, such as cell-phones, watches etc, various physical and mechanical properties of precious metals have become more critical for the durability of jewelry products. The demand for high yield strength, hardness, corrosion and erosion resistance, and wear and scratch resistance in such products is so overwhelming for the common precious metal-based alloys that new novel solutions are greatly desired.

SUMMARY OF THE INVENTION

The present invention is directed to jewelry comprising a precious metal-base alloy component in a bulk-solidified amorphous phase. In a preferred embodiment, the precious metal is selected from the group of Pd, Au and Pt.

In one embodiment of the invention, the precious metal-based amorphous alloy has a hardness of 400 Vickers or more. In a preferred embodiment of the invention, the precious metal-based amorphous alloy has a hardness of 500 Vickers or more.

In another embodiment of the invention, the precious metal-based amorphous alloy has a yield-strength of 1.2 GPa more. In a preferred embodiment of the invention, the precious metal-based amorphous alloy has a yield-strength of 1.8 GPa or more.

In still another embodiment of the invention, the precious metal-based amorphous alloy has an elastic strain limit of 1.5% more. In a preferred embodiment of the invention, the precious metal-based amorphous alloy has an elastic strain limit of 1.8% more.

In yet another embodiment of the invention, the precious metal-based amorphous alloy has thermal conductivity of less than 20 W/mK. In a preferred embodiment of the invention, the precious metal-based amorphous alloy has thermal conductivity less than 10 W/mK.

In still yet another embodiment of the invention, the precious metal-based amorphous alloy has a critical cooling rate less than 1000° C./second, and preferably less than 100° C./second, and most preferably less than 10° C./second.

In still yet another embodiment of the invention, the jewelry component is a casting of precious metal-based bulk-solidifying amorphous alloy. In a preferred embodiment of the invention, the jewelry component is an investment casting of precious metal-based bulk-solidifying amorphous alloy.

In still yet another embodiment of the invention, the jewelry is an earring, bracelet or necklace. In another embodiment of the invention, the jewelry is a watch-case. In another embodiment of the invention, the jewelry is a frame. In another embodiment of the invention, the jewelry is a frame as an enclosure for an electronic accessory. In another embodiment of the invention, the jewelry is a frame for pen. In another embodiment of the invention, the jewelry is a frame for glasses.

In still yet another embodiment of the invention, the jewelry comprises at lest one piece of a gemstone. In a preferred embodiment of the invention, the gemstone is natural diamond.

In still yet another embodiment of the invention, the metallic part of the jewelry is a precious metal-base alloy in bulk-solidified amorphous phase. In a preferred embodiment, the precious metal is selected from the group of Pd, Au and Pt.

In still yet another embodiment of the invention, the jewelry is a precious metal-base alloy in bulk-solidified amorphous phase. In a preferred embodiment, the precious metal is selected from the group of Pd, Au and Pt.

In still yet another embodiment of the invention, a precious metal-base bulk-solidifying amorphous alloy has a precious metal content of more than 58.3 weight percent. In a preferred embodiment of the invention, a precious metal-base bulk-solidifying amorphous alloy has a precious metal content of more than 75 weight percent, and in some cases more than 85 weight percent.

In still yet another embodiment of the invention, a precious metal-base bulk-solidifying amorphous alloy has a total content of more than 58.3 weight percent gold or platinum. In a preferred embodiment of the invention, the precious metal-base bulk-solidifying amorphous alloy has a total content of more than 58.3 weight percent gold or platinum.

In still yet another preferred embodiment of the invention, a precious metal-base bulk-solidifying amorphous alloy has no Nickel content (other than incidental impurities).

In still yet another embodiment of the invention, a molten piece of precious-metal base bulk-solidifying amorphous alloy is cast into a near-to-net shape jewelry component. In a preferred embodiment of the invention, a molten piece of precious-metal base bulk-solidifying amorphous alloy is investment-cast into a near-to-net shape jewelry component. In one preferred embodiment of the invention, the investment mold has a surface layer of fused silica.

In still yet another embodiment of the invention, a molten piece of precious-metal base bulk-solidifying amorphous alloy is cast over onto a gemstone to form a jewelry article. In a preferred embodiment of the invention, a molten piece of precious-metal base bulk-solidifying amorphous alloy is investment-cast over onto a gemstone to form a jewelry article.

In still yet another embodiment of the invention, a molten piece of precious-metal base bulk-solidifying amorphous alloy is cast into near-to-net shape jewelry component by metallic mold casting or die-casting.

In still yet another embodiment of the method of making jewelry component, a molten piece of precious metal-base bulk-solidifying amorphous alloy is cast into a jewelry component under partial vacuum, and preferably under full vacuum.

In still yet another embodiment of the method of making jewelry component, a molten piece of precious-metal base bulk-solidifying amorphous alloy is fed into the mold by applying an external pressure such as inert gas.

In still yet another embodiment of the invention, a solid feed-stock of precious-metal base bulk-solidifying amorphous alloy is heated into super-cooled viscous liquid regime and molded into near-to-net shape jewelry component.

In still yet another embodiment of the invention, a solid feed-stock of precious-metal base bulk-solidifying amorphous alloy is heated into super-cooled viscous liquid regime and molded over onto a gemstone to form a jewelry article.

DESCRIPTION OF THE INVENTION

The current invention is generally directed to jewelry articles comprising precious metal-base bulk-solidifying amorphous alloys and methods of making such jewelry articles.

The precious metal components of conventional jewelry articles are made of precious-metal base alloys, such as gold alloys, which has a poly-crystalline microstructure. In such alloys, the atomic structure shows highly ordered patterns extending over more than hundreds or thousands of atomic radii. Such atomic structure is called crystalline and the alloys are called crystalline alloys. In the current invention the precious metal alloy for the jewelry articles is maintained in a non-crystalline atomic structure. The non-crystalline atomic structure does not show such long-range ordered patterns, but rather a relatively random positioning of atoms, and is called a non-crystalline alloy, amorphous alloy, or metallic glass.

As it will be demonstrated in detail below, the inventors discovered that such atomic structure in precious metal-base alloys, specifically precious metal-base bulk-solidifying amorphous alloys, have unique and highly desirable advantages in jewelry applications. The demonstrated advantages are found both in the mechanical and physical properties of the articles, but also in the fabrication and finishing processes required to manufacture the articles.

The bulk-solidifying amorphous alloys are generally obtained by heavy alloying of one or more base metal such that a low melting temperature can be obtained. In the case of precious metals of Au, Pd, Pt, metalloid elements such as P, Si and other transition metals such as Ni, Cu or Co are used to suppress the melting temperatures of the alloys. The suppression of the melting temperature can be quantified by reduced glass transition, as defined in the scientific literature. The precious metal alloys are selected from a group of amorphous alloys with reduced glass transition of higher than 0.5, and preferably more than 0.6 and most preferably more than 0.66. Such alloys display a greater ability to form an amorphous phase during bulk-solidification.

In order to obtain amorphous phase formation during bulk solidification, such alloys are quenched at rates higher than critical cooling rates. Since the critical cooling rate can be correlated to the critical casting thickness by utilizing standard heat flow equations, a lower critical cooling rate provides a larger critical casting thickness for a given process and geometry. Accordingly, precious metal alloys are further selected from a group of amorphous alloys with critical cooling rates of less than $10^{3\circ}$ C./sec, and preferably less than $10^{2\circ}$ C./sec, and most preferably less than $10^{\circ}$ C./sec. Alternatively, precious metal alloys are further selected from a group of amorphous alloys with a critical casting thickness of more than 0.5 mm, and preferably more than 5.0 mm, and most preferably more than 25 mm.

Furthermore, the precious metal-base alloys are selected from a group of amorphous alloys with a larger ΔTsc (supercooled liquid region), a relative measure of the stability of the viscous liquid regime above the glass transition. Bulk-solidifying amorphous alloys with a ΔTsc of more than 60° C., and still more preferably a ΔTsc of 90° C. and more are desired for easy fabrication of jewelry components. ΔTsc is defined as the difference between Tx—the onset temperature of crystallization—and Tsc—the onset temperature of super-cooled liquid region. These values can be conveniently determined by using standard calorimetric techniques such as DSC measurements at 20° C./min. For the purposes of this disclosure, Tg, Tsc, and Tx are determined from standard DSC (Differential Scanning Calorimetry) scans at 20° C./min. Other heating rates such as 40° C./min, or 10° C./min can also be utilized while the basic physics of this disclosure still remaining intact. Herein, Tg is defined as the onset temperature of glass transition, Tsc is defined as the onset temperature of supercooled liquid region, and Tx is defined as the onset temperature of crystallization. ΔTsc is defined as the difference between Tx and Tsc. All the temperature units are in ° C. Exemplary alloy materials are described in U.S. Pat. Nos. 5,288,344; 5,368,659; 5,618,359; and 5,735,975 (the disclosures of which are incorporated in their entirety herein by reference).

In general, crystalline precipitates in bulk amorphous alloys are highly detrimental to their properties, especially to the toughness and strength of these materials, and as such it is generally preferred to minimize the volume fraction of these participates if possible. However, there are cases in which, ductile crystalline phases precipitate in-situ during the processing of bulk amorphous alloys, which are indeed beneficial to the properties of bulk amorphous alloys especially to the toughness and ductility. Such bulk amorphous alloys comprising such beneficial precipitates are also included in the current invention. One exemplary material is disclosed in (C. C. Hays et. al, Physical Review Letters, Vol. 84, p 2901, 2000), which is incorporated herein by reference.

In the bulk solidified amorphous phase, the precious metal-base alloys attain very high levels of strength and hardness. For example, Pd and Pt base alloys can reach 1.8 GPa or more in yield strength, whereas Au-based also attain yield strengths exceeding 1.2 GPa, or more in the bulk-solidified amorphous phase. These yield strength values are several times of the values for the crystalline phase of precious metal-base alloys used in jewelry application. Similar dramatic improvements are also achieved in hardness values, where Pd and Pt base alloys can reach 500 Vickers or more in hardness, and where Au-based can attain hardness values exceeding 400 Vickers or more in the bulk-solidified amorphous phase. These high hardnesses provides better scratch and wear resistance, and accordingly precious alloys having a hardness of 500 Vickers or more are preferred.

Furthermore, precious metal-base alloys in bulk-solidified amorphous phase have very high elastic strain limits, that is the ability to sustain strains without permanent deformation, typically around 1.5% or higher, several times higher than conventional precious-metal alloys in jewelry use. This is an important characteristic for the use and application in a jewelry component, as the resistance to dents and nicks will be greatly improved. Furthermore, the combination of high elastic strain limit and high yield strength helps to maintain both the general shape and intricate details of the jewelry components intact. The periodical mechanical adjustment of metallic components of the jewelry can also be avoided since no significant mechanical deformation will be accumulated from the regular use. In the case of jewelry incorporating gemstones, the durability for precise position of gemstones are greatly improved. As such, the maintenance of metallic components in jewelry will be greatly reduced as the surface finish will be more durable and more easily maintained.

The advantage of bulk-solidified amorphous phase is not limited to the above-mentioned mechanical properties. The homogeneity of the microstructure of the amorphous phase—due to lack of poly-crystallites and directionality of atomic order—provides a better resistance against corrosion and local pitting. The advantage of this unique microstructure becomes especially amplified in highly alloyed precious metal-base alloys, as alloying additions tend to reduce or negate the favorable corrosion characteristics of the precious metals. As such, bulk-solidified amorphous phases maintain their surface finishes longer, providing long life with a reduced maintenance of the jewelry articles.

Another highly surprising advantage of the bulk-solidified amorphous phase for jewelry components, especially for the ones worn on the body or having frequent body contact, is its low level of thermal conductivity. The thermal conductivity of precious-metal base bulk-solidified amorphous phase is an order of magnitude or more less than a typical precious metal in crystalline phase. For example, the thermal conductivity of Pd, Au, Pt base amorphous alloys is generally less than 10 W/mK, whereas pure gold has a thermal conductivity of more than 400 W/mK. Precious metals (in their common crystalline phase) have very high thermal and electrical conductivity. As such, typical precious metal components of jewelry articles cause relative discomfort upon handling during adverse weather conditions dramatizing the feel of cold or hot. On the other, the low thermal conductivity of bulk-solidified amorphous phase provides a negating effect on adverse weather conditions upon handling, providing a better warm-feel to the handler or wearer.

The advantages of using bulk-solidified amorphous phases extends to the fabrication characteristics of these alloys, and as such the current invention provides preferred methods of fabrication and finishing such jewelry components. For example, the above mentioned favorable mechanical and physical properties of bulk-solidified amorphous phase are readily obtained in an as-cast condition. This is generally not true for conventional crystalline metals and alloys as which require additional thermo-mechanical methods or tedious work hardening processes to improve the mechanical properties of these alloys.

The precious-metal based bulk-solidifying amorphous alloys, by their design, have much lower melting temperatures than the melting temperatures of their constituents. This is especially true when compared to their weighed averages of melting temperatures. Although it may be argued that amorphous alloys do not experience a melting phenomenon in the same manner as a crystalline material, it is convenient to describe a "melting point" at which the viscosity of the material is so low that, to the observer, it behaves as a melted solid. The melting point or melting temperature of the amorphous metal may be considered as the temperature at which the viscosity of the material falls below about $10^2$ poise. Alternatively, the melting temperature of the crystalline phases of the bulk-solidifying amorphous alloy composition can be taken as the melting temperature of the amorphous alloy. For example, Pd-base bulk solidifying amorphous alloys have typical melting temperatures of 800° C. or less and the melting temperature of Pt-base alloys can be as low as less than 600° C. A lower melting temperature is preferred for the ease of processing and accordingly, melting temperatures of less than 700° C. and preferably less than 600° C. are desired Such low melting temperatures of precious-metal based bulk-solidifying amorphous alloys are beneficially utilized in a casting process to fabricate jewelry components and articles. The low melting temperature negates the complexities arising in the mold materials used, and the melting practices required to handle the high melting temperatures. The low melting temperatures of the precious-metal based bulk-solidifying amorphous alloys also provide a relatively easier casting operation such as reduced or minimal reaction with molds or investment shells. Furthermore, such low meting temperatures are especially beneficial, when casting precious metals as jewelry articles incorporating gemstones. The over-casting of molten alloy over gemstones can very much damage the quality of gemstones. For example, natural diamond can withstand temperatures up to 1,000° C. at least on a temporary basis. Accordingly, low melting temperatures of below 1,000° C. are conveniently utilized in casting precious-metal based bulk-solidifying amorphous alloys over and onto gemstones, for example over and onto natural diamond.

Furthermore, precious metal-based bulk solidifying amorphous alloys can be readily cast from molten state to replicate the very fine details of the mold cavity intended for jewelry components and articles. The lack of any first-order phase transformation during the solidification of bulk-solidifying amorphous alloy reduces solidification shrinkage and as such provides a near-to-net shape configuration of the metallic component. In addition, bulk-solidifying amorphous alloys keep their fluidity to exceptionally low temperatures, down to its glass transition temperatures, compared to other metal castings alloys. For example, Pd and Pt base have typical glass transition temperatures in the range of 200° C. to 400° C. depending on the alloy composition. These characteristics combined with the lack of any microstructure allow bulk-solidifying amorphous alloys to replicate the intricacies of the impressions at exceptional quality. This unique casting characteristics not only reduces the post-cast finishing processes, but also provide a better surface finish and preparation due to the reduced or minimal defects arising from the casting operation. For example, jewelry components of precious-metal base bulk-solidifying amorphous alloys can be given a very high polish and surface smoothness for improved aesthetics concerns.

The proliferation of such dramatic improvements in both physical/mechanical properties and fabrication characteristics allow novel and unique design and applications in jewelry that have not been possible or conceived before. Fine and elaborate details require good structural integrity and easy fabricability. As such higher strength and easy processable precious metal-base bulk-solidifying amorphous alloys are conveniently applied to such designs, such as thinner shells and smaller structures than possible with conventional precious metals and alloys. Alternatively, the negative effects of low strength and hardness common to crystalline precious metals, are mitigated to the extent that designers can focus more the aesthetics and beauty aspects rather than the mechanical integrity of jewelry component.

The jewelry component of precious-metal based bulk-solidifying amorphous alloys may be fabricated by various casting methods. In this method, a feedstock of bulk-solidifying amorphous alloy composition is provided. This feedstock does not to have to be in amorphous phase. Then the feedstock alloy is heated into the molten state above the melting temperature of bulk-solidifying amorphous alloy. Then the molten alloy is fed into the mold having the shape of desired jewelry component and quenched to temperatures below the glass transition. In the case of metallic mold-casting, such as die-casting, the thermal mass of die and mold can provide the sufficient quenching to the temperatures below the glass transition. In the case of investment casting, the investment mold is immersed into a quenching bath to form a substantially amorphous atomic structure. The casting of the bulk amorphous alloy is then removed from the mold to apply other post-cast finishing processes such as polishing. Though, there are various choices of materials exist for investment mold, fused silica is a preferred choice material for investment casting. In some cases, it is desirable to superheat the molten alloy well above the melting temperature by 100° C. or more. This will provide higher fluidity and will allow the molten alloy to flow a much longer time before solidification. This is especially preferred in cases where jewelry components with very high aspect ratios (i.e. long and skinny shapes) and high intricacies are desired.

In another casting method, a feedstock alloy is heated into the molten state under an inert atmosphere and preferably under vacuum. The mold can be prepared by various methods and preferably by an investment-cast method. Various mechanisms can be utilized to feed the molten alloy into the mold. Gravity-feeding methods can be readily utilized, though other mechanisms providing external pressure is preferred. Such mechanisms can use centrifugal forces and inert gas pressure. Various configurations of alloy feeding can be utilized such as bottom-feeding. Another feeding method comprises counter-gravity feeding and casting and preferably carried out with vacuum suction assistance.

In an alternative fabrication method, a solid feedstock of precious metal-based alloy in the amorphous phase is heated into the super-cooled viscous liquid regime and deformed into the desired shapes of jewelry component and subsequently cooled to below the glass transition. Such method can also can be used to over-mold viscous alloy onto a gemstone to form a jewelry article. Such a process is especially preferable for encasing and holding of gemstones with lower temperature stability. For the ease of processing a lower glass transition is also desired to be less than 300° C. and preferably between 200° C. and 250° C.

Although specific embodiments are disclosed herein, it is expected that persons skilled in the art can and will design alternative jewelry articles and methods of manufacture that are within the scope of the following claims either literally or under the Doctrine of Equivalents.

What is claimed is:

1. An article of jewelry constructed at least partially of a amorphous alloy having a bulk-solidified amorphous phase, wherein the amorphous alloy contains a precious metal selected from the group consisting of Pd, Pt and Au, and wherein the amorphous alloy has a precious metal content of at least 75% by weight.

2. The article as described in claim 1, wherein the amorphous alloy has a hardness of 400 Vickers or more.

3. The article as described in claim 1, wherein the amorphous alloy has a yield-strength of 1.2 GPa more.

4. The article as described in claim 1, wherein the amorphous alloy has an elastic strain limit of 1.5% more.

5. The article as described in claim 1, wherein the amorphous alloy has an elastic strain limit of 1.8% more.

6. The article as described in claim 1, wherein the amorphous alloy has a thermal conductivity of less than 20 W/mK.

7. The article as described in claim 1, wherein the amorphous alloy has a critical cooling rate less than 1000° C./second.

8. The article as described in claim 1, wherein the amorphous alloy has a critical cooling rate less than 100° C./second.

9. The article as described in claim 1, wherein the amorphous alloy has a critical cooling rate less than 10° C./second.

10. The article as described in claim 1, wherein the amorphous alloy has a delta T of 60° C. or more.

11. The article as described in claim 1, wherein the amorphous alloy has a delta T of 90° C. or more.

12. The article as described in claim 1, wherein the amorphous alloy has a reduced glass transition temperature, Trg, of 0.6 or more.

13. The article as described in claim 1, wherein the amorphous alloy has a glass transition temperature, Tg, of 300° C. or less.

14. The article as described in claim 1, wherein the amorphous alloy has a glass transition temperature, Tg, between 200° C. and 250° C.

15. The article as described in claim 1, wherein the amorphous alloy has a melting temperature, Tm, of less than 700° C.

16. The article as described in claim 1, wherein the amorphous alloy has a melting temperature, Tm, of less than 600° C.

17. The article as described in claim 1, wherein a portion of the amorphous alloy has a thickness of more than 0.5 mm.

18. The article as described in claim 1, wherein a portion of the amorphous alloy has a thickness of more than 5 mm.

19. The article as described in claim 1, wherein the precious metal is Au, and wherein the Au comprises at least 58.3 percent weight of the amorphous alloy.

20. The article as described in claim 1, wherein the precious metal content of the amorphous alloy is substantially Pt.

21. The article as described in claim 1, wherein the precious metals comprise at least 85 percent weight of the amorphous alloy.

22. The article as described in claim 1, wherein the precious metal is substantially Pt, and wherein the Pt comprises at least 85 percent weight of the amorphous alloy.

23. The article as described in claim 1, wherein the article is an investment casting of the precious metal-based bulk-solidifying amorphous alloy.

24. The article as described in claim 1, wherein the article is selected from the group consisting of an earring, bracelet, necklace, watch-case, frame, enclosure for an electronic accessory, pen, and frame for glasses.

25. The article as described in claim 1, wherein the metallic part of the article is made of the precious metal-base alloy in bulk-solidified amorphous phase.

26. The article as described in claim 1, wherein the amorphous alloy has substantially no Nickel content.

27. A method of manufacturing an article of jewelry comprising:

providing a molten piece of bulk-solidifying amorphous alloy wherein the amorphous alloy contains a precious metal selected from the group consisting of Pd, Pt and Au, and wherein the amorphous alloy has a precious metal content of at least 75% by weight;

providing a mold having the form of a desired jewelry component; and casting the molten amorphous alloy into a near-to-net shape jewelry component.

28. The method as described in claim 27, wherein the casting comprises investment-cast.

29. The method as described in claim 27, wherein the mold has a surface layer of fused silica.

30. The method as described in claim 27, wherein the molten piece of precious-metal base bulk-solidifying amorphous alloy is cast over at least one gemstone.

31. The method as described in claim 27, wherein the casting comprises one of either metallic mold casting or die-casting.

32. The method as described in claim 27, wherein the casting is conducted under one of either a partial vacuum or full vacuum.

33. The method as described in claim 27, further comprising feeding the molten piece of precious-metal base bulk-solidifying amorphous alloy into the mold by applying an external pressure.

34. A method of manufacturing an article of jewelry comprising:

providing a solid feed-stock of precious-metal base bulk-solidifying amorphous alloy, wherein the amorphous alloy contains a precious metal selected from the group consisting of Pd, Pt and Au, and wherein the amorphous alloy has a precious metal content of at least 75% by weight;

heating the amorphous alloy into a super-cooled viscous liquid regime; and molding the heated amorphous alloy into a near-to-net shape jewelry component.

* * * * *

UNITED STATES PATENT AND TRADEMARK OFFICE

CERTIFICATE OF CORRECTION

PATENT NO. : 7,412,848 B2
APPLICATION NO. : 10/534375
DATED : August 19, 2008
INVENTOR(S) : William L. Johnson It is certified that error appears in the above-identified patent and that said Letters Patent is hereby corrected as shown below:

On the Title Page, Item (56) add the following patents to the list of references 5203183 Salerno
6058737 Domagala
3654774 Van Bergen Signed and Sealed this Twenty-fourth Day of August, 2010

David J. Kappos

David J. Kappos
*Director of the United States Patent and Trademark Office*